US009461396B2

(12) United States Patent
Wang

(10) Patent No.: US 9,461,396 B2
(45) Date of Patent: Oct. 4, 2016

(54) INDOOR ANTENNA

(71) Applicant: TRANS ELECTRIC CO., LTD., Changhua Hsien (TW)

(72) Inventor: Cheng-Si Wang, Changhua Hsien (TW)

(73) Assignee: TRANS ELECTRIC CO., LTD., Changhua Hsien (TW)

( * ) Notice: Subject to any disclaimer, the term of this patent is extended or adjusted under 35 U.S.C. 154(b) by 0 days.

(21) Appl. No.: 14/540,353

(22) Filed: Nov. 13, 2014

(65) Prior Publication Data

US 2016/0141791 A1 May 19, 2016

(51) Int. Cl.
*H01R 13/516* (2006.01)
*H01Q 1/50* (2006.01)

(52) U.S. Cl.
CPC ..... *H01R 13/516* (2013.01); *H01Q 1/50* (2013.01)

(58) Field of Classification Search
CPC .... H01R 13/72; H01R 13/60; H01R 25/003; H02G 11/02; H02G 11/00
USPC ..... 439/501, 578–585; 343/702, 895, 793
See application file for complete search history.

(56) References Cited

U.S. PATENT DOCUMENTS 4,090,030 A * 5/1978 Lagasse ..... H01Q 1/1214 174/153 A
6,373,438 B1 * 4/2002 Hwang ..... H01Q 1/22 343/702
7,193,582 B2 * 3/2007 Wang ..... H01Q 9/42 343/702

* cited by examiner

*Primary Examiner* — Edwin A. Leon
(74) *Attorney, Agent, or Firm* — Rabin & Berdo, P.C.

(57) ABSTRACT

An indoor antenna has a base panel, a coax cable panel, a coax cable, a panel cover, and a hole cover. The coax cable panel is combined with the base panel. The coax cable is electrically connected with the coax cable panel and is connected with a plug. The panel cover is combined with the base panel, shelters the coax cable panel and has a cover through hole inserted through by the coax cable. The hole cover is mounted in the cover through hole of the panel cover and has a coax cable recess inserted through by the coax cable with the plug. Therefore, when the indoor antenna is assembled, the coax cable with the plug can be inserted through the cover through hole, and the indoor antenna can be assembled smoothly and modularized easily.

18 Claims, 6 Drawing Sheets

INDOOR ANTENNA

BACKGROUND OF THE INVENTION

1. Field of the Invention

The present invention relates to an antenna, and more particularly to an indoor antenna.

2. Description of Related Art

A conventional indoor antenna is applied for receiving a digital signal, and a terminal connector or a cable is adopted to connect with and outputs the digital signal to a television or a telecommunication equipment.

The conventional indoor antenna that adopts the terminal connector is welded with a cable panel. In a manufacturing process, a casing and other components of the indoor antenna may be interfered with the terminal connector to affect a manufacturing performance. Furthermore, a welding position between the cable panel and the terminal connector may be affected to be detached from the cable panel. The terminal connector has a relative high cost, such that the indoor antenna may have a relative manufacturing high cost. The terminal connector may further affect a volume of the indoor antenna. Therefore, the cable is usually adopted in the conventional indoor antenna.

With reference to FIG. 6, the conventional indoor antenna 90 that adopts the cable 92 further has a cover 91, a cable panel, a hanging hole 93, a pad 94, and a bracket 95. The cable panel is mounted in the cover 92. The cable 92 is electrically connected with the cable panel and is inserted out of the cover 91. The hanging hole 93 is formed in a rear side of the cover 91 for the antenna 90 being hanged on a wall. The pad 94 is mounted on the rear side of the cover 91 for the antenna 90 being flatted on a ground. The bracket 95 is mounted on the rear side of the cover 91 for standing the antenna 90 on the ground. Therefore, in assembling, the indoor antenna can be assembled by different ways depending on different demands.

The cable 92 is directly inserted through a cable hole of the cover 91 and is welded on the cable panel. In manufacturing, when the cable 92 is inserted through the cable hole of the cover 91, the cable 92 is tied on the cover 91. Therefore, the cover 91 may be affected by the cable 92, so the assembling is inconvenience for a user. Furthermore, the cover 91 may be damaged because the cable 92 since the cable 92 is tied on the cover 91.

SUMMARY OF THE INVENTION

The main objective of the present invention is to provide an indoor antenna to resolve the afore-mentioned problems.

The indoor antenna has a base panel, a coax cable panel, a coax cable, a panel cover, and a hole cover. The coax cable panel is combined with the base panel.coax cable The coax cable is electrically connected with the coax cable panel.

The panel cover is combined with the base panel, shelters the coax cable panel and has a cover through hole inserted through by the coax cable.

The hole cover is mounted in the cover through hole of the panel cover and has a coax cable recess inserted through by the coax cable.

Other objectives, advantages and novel features of the present invention will become more apparent from the following detailed description when taken in conjunction with the accompanying drawings.

DETAILED DESCRIPTION OF PREFERRED EMBODIMENT

Figure 1:
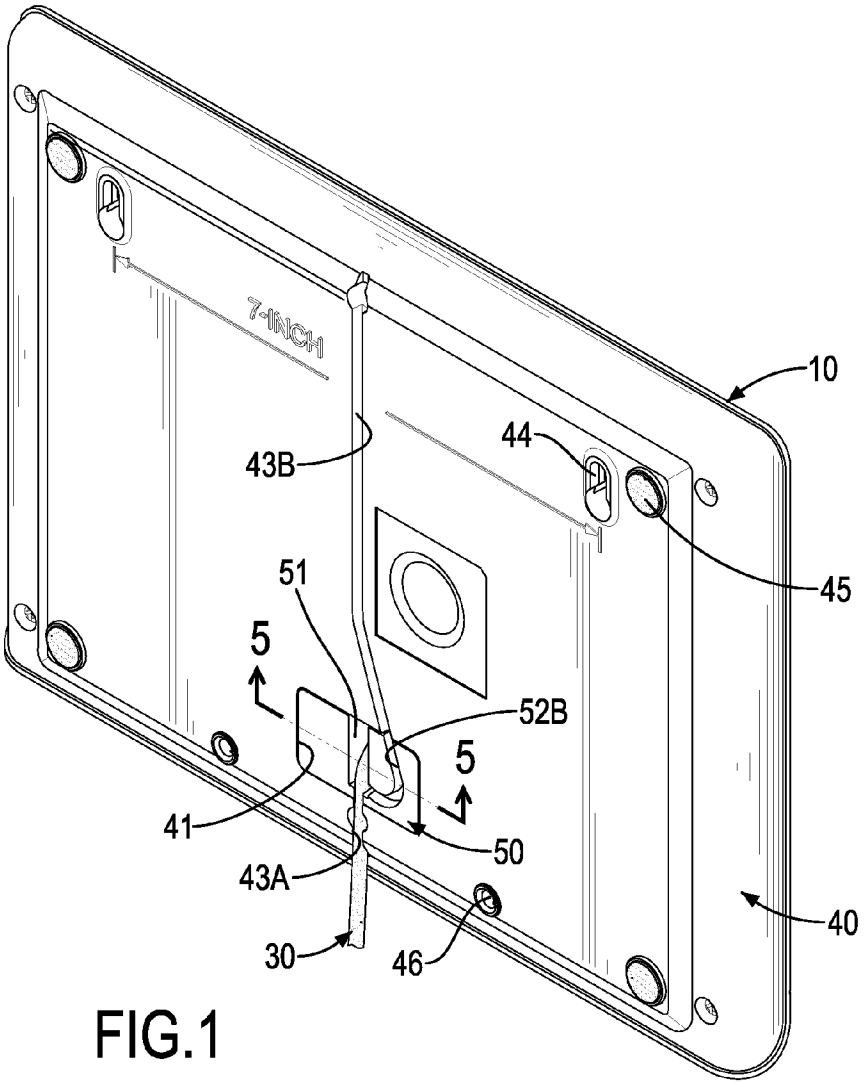
FIG. 1 is a perspective view of a preferred embodiment of an indoor antenna in accordance with the present invention.

With reference to FIGS. 1 to 5, a preferred embodiment of an indoor antenna in accordance with the present invention has a base panel 10, a coax cable panel 20, a coax cable 30, a panel cover 40, and a hole cover 50.

Figure 2:
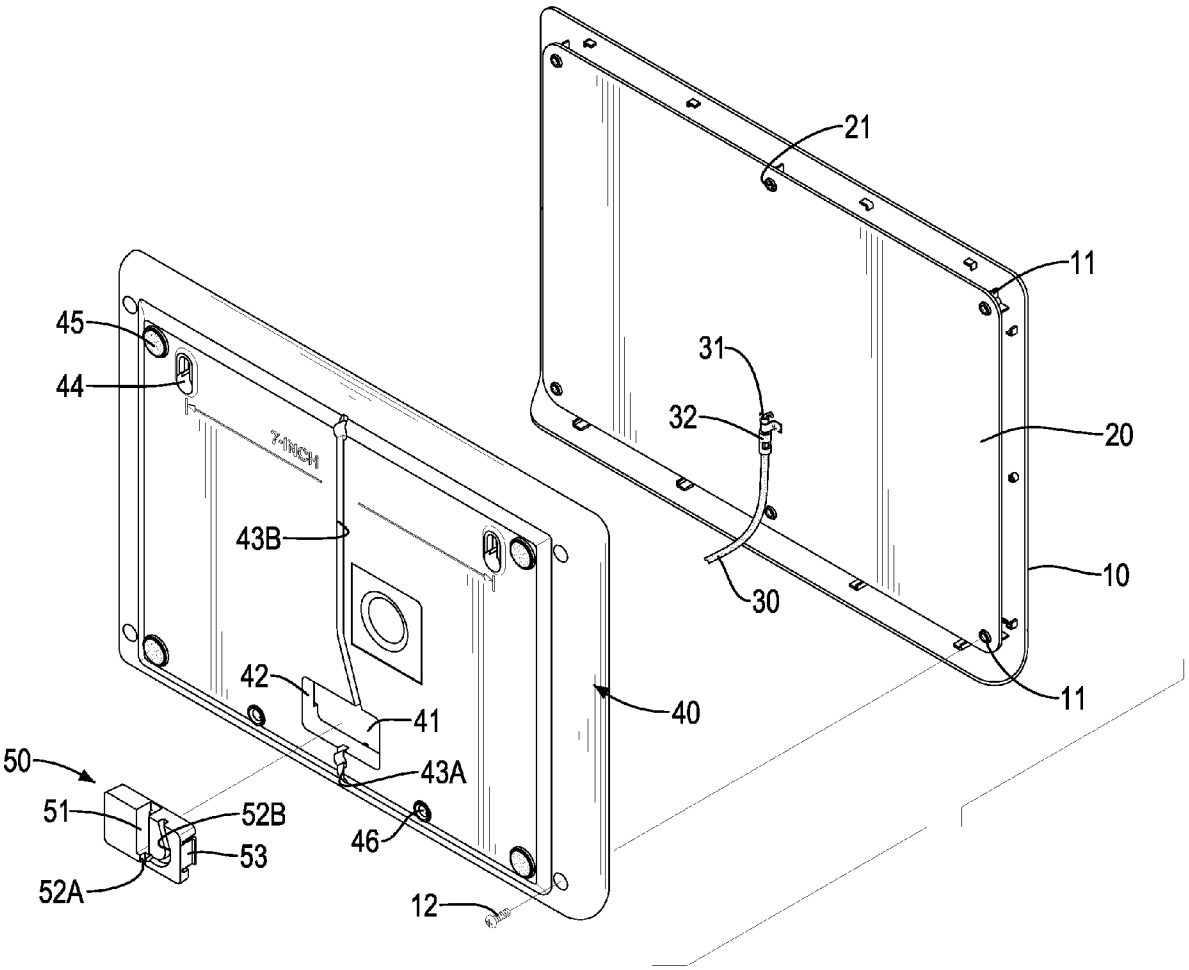
FIG. 2 is an exploded perspective view of the indoor antenna in FIG. 1.
Figure 3:
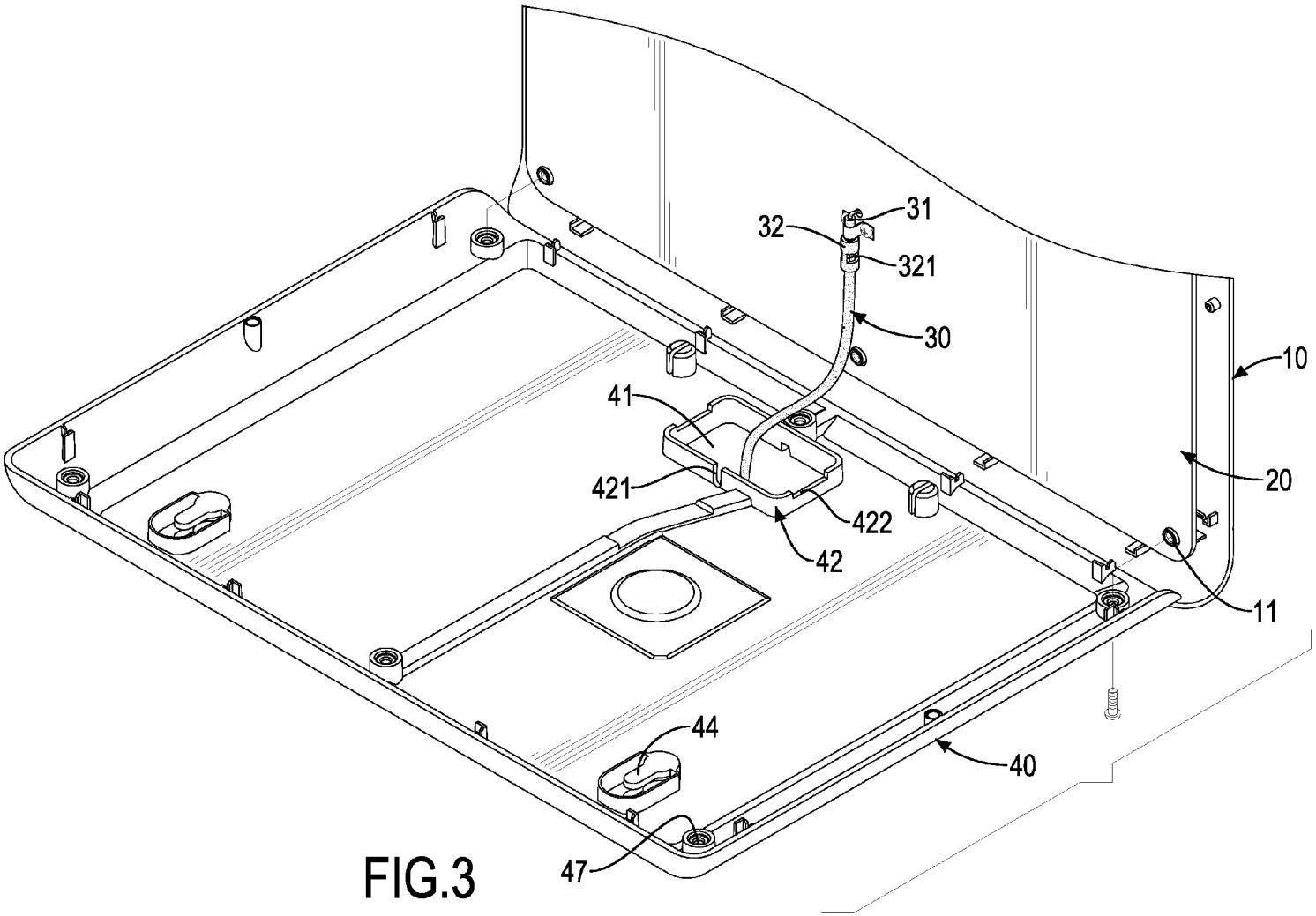
FIG. 3 is an enlarged exploded perspective view of the indoor antenna in FIG. 1.

With reference to FIGS. 2 and 3, the base panel 10 may be rectangular and is located at a front side of the indoor antenna. The base panel 10 has a rear side and multiple fixing columns 11 annularly arranged on the rear side of the base panel 10 at intervals.

The coax cable panel 20 may be rectangular and is combined with the base panel 10. The coax cable panel 20 has multiple position holes 21 formed through the coax cable panel 20 and respectively mounted around the fixing columns 11, such that the coax cable panel 20 can be mounted on and positioned on the rear side of the base panel 10.

Figure 4:
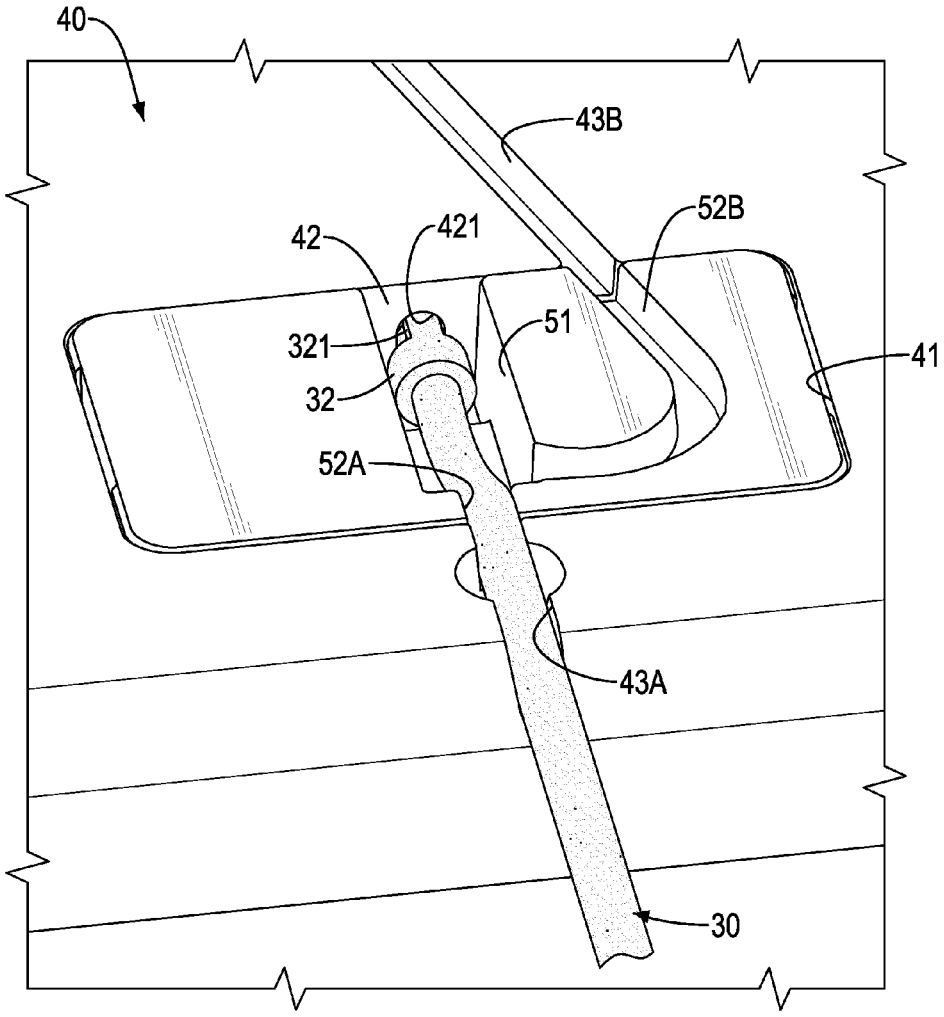
FIG. 4 is an enlarged perspective view of the indoor antenna in FIG. 1.

With reference to FIGS. 3 and 4, the coax cable 30 may be a coaxial coax cable and is welded on and electrically connected with the coax cable panel 20. The coax cable 30 has a connecting end 31 is welded on and electrically connected with a desired position of the coax cable panel 20. A position sleeve 32 is mounted around the coax cable 30 and is adjacent to the connecting end 31. An outer diameter of the position sleeve 32 is larger than an outer diameter of the coax cable 30. The position sleeve 32 has two engagement recesses 321 respectively formed in two sides of the position sleeve 32. The coax cable 30 further has a connector end connected with a plug that can be connected with a television or a communication product.

With reference to FIGS. 2 to 4, the panel cover 40 may be rectangular, is combined with the base panel 10 and shelters the coax cable panel 20. The panel cover 40 and the base panel 10 is combined with each other to form a cover body of the indoor antenna. The panel cover 40 has multiple panel cover hole 47 formed in a first side of the panel cover 40 at intervals and respectively aligned with the fixing columns 11. Multiple bolts 12 are respectively inserted into the panel cover hole 47 and respectively combined with the fixing columns 11, such that the panel cover 40 can be fixed on the base panel 10 to form the cover body, and the coax cable panel 20 can be sheltered between the base panel 10 and the panel cover 40.

The panel cover 40 has an edge, a cover through hole 41, a hole wall 42, at least one first coax cable channel 43A, 43B, a pairs of hanging holes 44, multiple pads 45, and a pair of bracket holes 46. The edge is formed annularly around the panel cover 40. The cover through hole 41 may be rectangular, is formed through the panel cover 40 and is adjacent to a bottom of the panel cover 40. The coax cable 30 is inserted through the panel cover 40 via the cover through hole 41. The hole wall 42 is formed on the first side of the panel cover 40 and annularly around the cover through hole 41 and has a coax cable slit 421 and two engagement notches 422. The coax cable slit 421 is formed through the hole wall 42 and accommodating the coax cable 30, such that the coax cable 30 can be inserted through the coax cable slit 421 and through the panel cover 40 via the cover through hole 41. The engagement recess 321 of the position sleeve 32 is clamped by the coax cable slit 421, such that when the panel cover 40 is combined with the base panel 10, a position of the coax cable 30 can be fixed. The engagement notches 422 are formed in the hole wall 42 at two positioned opposite to each other.

The at least one first coax cable channels 43A, 43B are elongated, are formed in a second side of the panel cover 40 and formed toward and through the edge of the panel cover 40, wherein a width of any one of the first coax cable channels 43A, 43B is not less than a diameter of the coax cable 30, such that the coax cable 30 can be mounted in one of the first coax cable channels 43A, 43B. Each first coax cable channel 43A, 43B has an extended direction. Preferably, The first coax cable channel 43A is formed toward and through a top of the edge of the panel cover 40. The first coax cable channel 43B is formed toward and through a bottom of the edge of the panel cover 40, and the extended direction of the first coax cable channel 43B is different from the one of the first coax cable channel 43A. The coax cable 30 is selectively mounted in and along one of the first coax cable channels 43A, 43B and extends out of the edge of the panel cover 40.

Alternatively, the panel cover 40 may have more than two first coax cable channels 43A, 43B, and extension directions of the first coax cable channels 43A, 43B are not limited in the present invention. The panel cover 40 may have eight first coax cable channels radially formed in the first side of the panel cover 40 to provide eight extended directions for the coax cable 30 to select.

The pair of hanging holes 44 is formed in the second side of the panel cover 40. The pads 45 are mounted on the second side of the panel cover 40. The pair of bracket holes 46 is formed in the second side of the panel cover 40, wherein a bracket can be mounted in the pair of bracket holes 46. The pair of hanging holes 44, the pads 45 and the pair of bracket holes 46 can provide different assembling ways for the indoor antenna. The indoor antenna can be hanged on a wall via the pair of the hanging holes 44, can be flatted on a ground by the pads 45, or can stand on the ground by the bracket mounted in the pair of the bracket holes 46 according to different demands of the user.

The hole cover 50 may be rectangular, is combined in the cover through hole 41 and has a coax cable recess 51, at least one second coax cable channel 52A, 52B, and two engagement plates 53. The coax cable recess 51 is formed in a side of the hole cover 50, accommodating the coax cable 30 and aligned with the coax cable slit 421. The at least one second coax cable channel 52A, 52B is formed in the side of the hole cover 50, communicates with the coax cable recess 51 and communicates with the at least one first coax cable channel 43A, 43B. The coax cable 30 can be mounted in the at least one first coax cable channel 43A, 43B, and be mounted in the at least one second coax cable channel 52A, 52B which communicates with the first coax cable channel 43A, 43B.

Preferably, the hole cover 50 has two second coax cable channels 52A, 52B respectively communicating with the first coax cable channels 43A, 43B. Alternatively, the second coax cable channels 52A, 52B may be omitted, and the coax cable recess 51 directly communicates with the first coax cable channels 43A, 43B.

Figure 5:
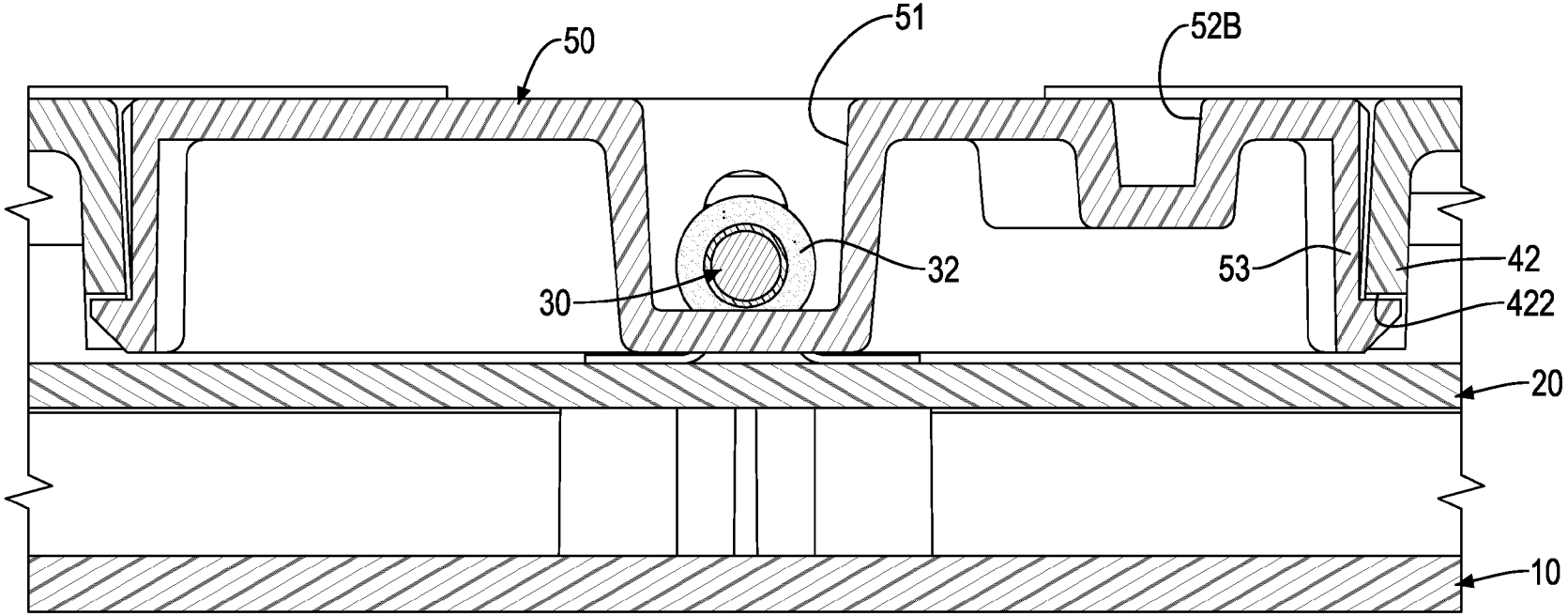
FIG. 5 is an enlarged cross sectional side view of the indoor antenna in FIG. 1.
Figure 6:
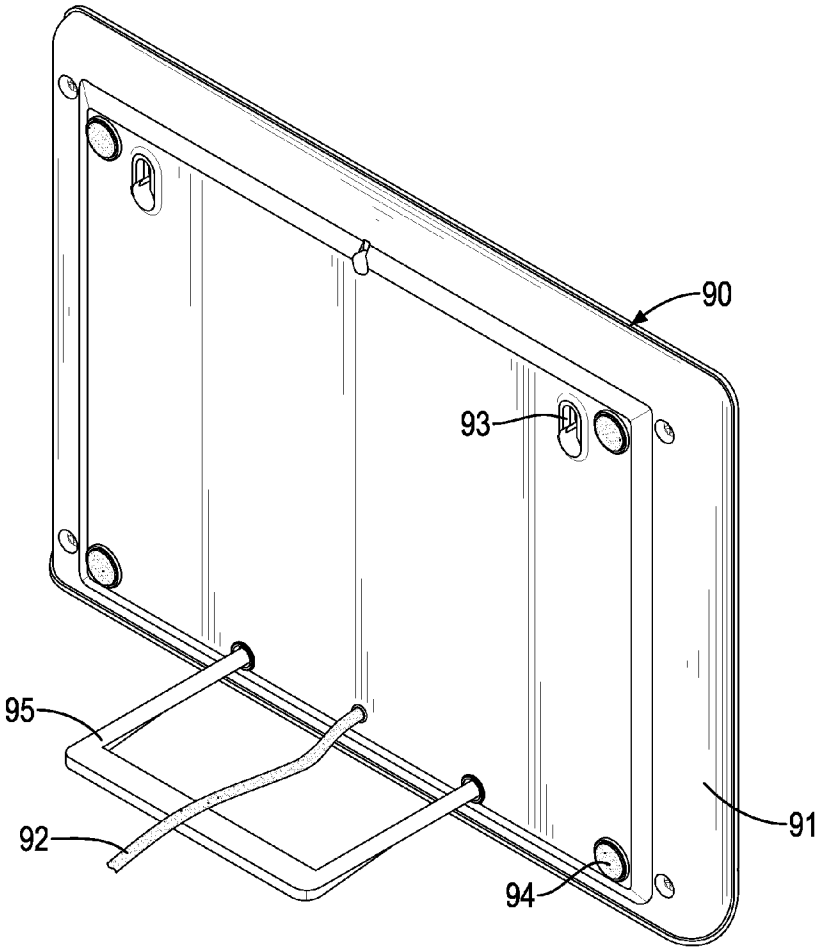
FIG.6 PRIOR ART
FIG. 6 is a perspective view of a conventional indoor. antenna.

Further with reference to FIG. 5, the engagement plates 53 are elastic, are formed on the hole cover 50 and are detachably engaged with the engagement notches 422, such that the hole cover 50 can be detachably mounted in the cover through hole 41.

With reference to FIGS. 2 to 4, in use, the cover through hole 41 can be inserted through by the coax cable 30, such that the coax cable 30 does not have to be mounted on the panel cover 40 in advance. The connecting end 31 of the coax cable 30 is welded on the coax cable panel 20, and then the coax cable 30 extends out of the cover through hole 41. Then, the position sleeve 32 is positioned on the coax cable slits 421. Finally, after the engagement plates 53 is engaged with the cover through hole 41, the indoor antenna is completed.

From the above description, it is noted that the present invention has the following advantages:

1. The panel cover 40 has the cover through hole 41, such that the coax cable 30 can be welded on the coax cable panel 20, and then the coax cable 30 is inserted through the cover through hole 41. Finally, the hole cover 50 is mounted in the cover through hole 41. Therefore, the assembling of the indoor antenna can be modularized to provide a relative low cost effect. The assembling of the indoor antenna is simplified, and a performance of the assembling is improved.

2. The cover through hole 41 cooperates with the hole cover 50, such that the coax cable 30 and the panel cover 40 cannot be interfered with each other. Therefore, the base panel 10 and the panel cover 40 can be kept from being damaged by the coax cable 30. A yield of the indoor antenna can be improved.

3. The coax cable 30 is positioned in the coax cable slit 421, such that the coax cable 30 can be kept from being pulled, and the connecting end 31 can be kept from being damaged. Therefore, a lifetime of the indoor antenna can be improved.

4. The panel cover 40 has the first coax cable channels 43A, 43B to allow the coax cable 30 to be mounted in. Therefore, when the indoor antenna is assembled by different ways, the first coax cable channels 43A, 43B can accommodate the coax cable 30 to keep the coax cable 30 from being bent. The adhesiveness of the indoor antenna can be increased.

Even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An indoor antenna having:

a base panel;

a coax cable panel combined with the base panel;

a coax cable electrically connected with the coax cable panel;

a panel cover combined with the base panel, sheltering the coax cable panel and having a cover through hole inserted through by the coax cable, the panel cover further having a hole wall formed on the panel cover and annularly around the cover through hole, wherein the hole wall has a coax cable slit accommodating the coax cable; and a hole cover mounted in the cover through hole of the panel cover and having a coax cable recess inserted through by the coax cable.

2. The indoor antenna as claimed in claim 1, wherein the coax cable further has a position sleeve mounted around the coax cable, and an outer diameter of the position sleeve is larger than an outer diameter of the coax cable, and the position sleeve is clamped by the coax cable slit.

3. The indoor antenna as claimed in claim 2, wherein the position sleeve further has two engagement recesses clamped by the coax cable slit.

4. The indoor antenna as claimed in claim 3, wherein the cover through hole and the hole cover are rectangular.

5. The indoor antenna as claimed in claim 1, wherein the panel cover further has two engagement notches formed in the hole wall; and the hole cover further has two engagement plates detachably engaged with the engagement notches.

6. The indoor antenna as claimed in claim 2, wherein the panel cover further has two engagement notches formed in the hole wall; and the hole cover further has two engagement plates detachably engaged with the engagement notches.

7. The indoor antenna as claimed in claim 3, wherein the panel cover further has two engagement notches formed in the hole wall; and the hole cover further has two engagement plates detachably engaged with the engagement notches.

8. The indoor antenna as claimed in claim 4, wherein the panel cover further has two engagement notches formed in the hole wall; and the hole cover further has two engagement plates detachably engaged with the engagement notches.

9. The indoor antenna as claimed in claim 5, wherein the panel cover further has at least one first coax cable channel formed in the panel cover, communicating with the cover through hole and extending toward and through an edge of the panel cover, wherein the coax cable is mounted in one of the at least one first coax cable channel.

10. The indoor antenna as claimed in claim 6, wherein the panel cover further has at least one first coax cable channel formed in the panel cover, communicating with the cover through hole and extending toward and through an edge of the panel cover, wherein the coax cable is mounted in one of the at least one first coax cable channel.

11. The indoor antenna as claimed in claim 7, wherein the panel cover further has at least one first coax cable channel formed in the panel cover, communicating with the cover through hole and extending toward and through an edge of the panel cover, wherein the coax cable is mounted in one of the at least one first coax cable channel.

12. The indoor antenna as claimed in claim 8, wherein the panel cover further has at least one first coax cable channel formed in the panel cover, communicating with the cover through hole and extending toward and through an edge of the panel cover, wherein the coax cable is mounted in one of the at least one first coax cable channel.

13. The indoor antenna as claimed in claim 9, wherein the hole cover further has at least one second coax cable channel formed in the hole cover, communicating with the coax cable recess and one of the at least one first coax cable channel, wherein the coax cable is mounted in one of the at least one second coax cable channel.

14. The indoor antenna as claimed in claim 10, wherein the hole cover further has at least one second coax cable channel formed in the hole cover, communicating with the coax cable recess and one of the at least one first coax cable channel, wherein the coax cable is mounted in one of the at least one second coax cable channel.

15. The indoor antenna as claimed in claim 11, wherein the hole cover further has at least one second coax cable channel formed in the hole cover, communicating with the coax cable recess and one of the at least one first coax cable channel, wherein the coax cable is mounted in one of the at least one second coax cable channel.

16. The indoor antenna as claimed in claim 12, wherein the hole cover further has at least one second coax cable channel formed in the hole cover, communicating with the coax cable recess and one of the at least one first coax cable channel, wherein the coax cable is mounted in one of the at least one second coax cable channel.

17. The indoor antenna as claimed in claim 13, wherein the panel cover totally has two first coax cable channels, wherein one of the first coax cable channels extends toward and is formed through a top of the edge of the panel cover, and the other first coax cable channel extends toward and is formed through a bottom of the edge of the panel cover.

18. The indoor antenna as claimed in claim 16, wherein the panel cover totally has two first coax cable channels, wherein one of the first coax cable channels extends toward and is formed through a top of the edge of the panel cover, and the other first coax cable channel extends toward and is formed through a bottom of the edge of the panel cover.

* * * * *